US007721356B2

(12) United States Patent
Utaka

(10) Patent No.: US 7,721,356 B2
(45) Date of Patent: May 25, 2010

(54) CLOTHES WITH CROTCH PART

(75) Inventor: Shohei Utaka, Kasai (JP)

(73) Assignee: Utax Co., Ltd., Hyogo (JP)

( * ) Notice: Subject to any disclaimer, the term of this patent is extended or adjusted under 35 U.S.C. 154(b) by 244 days.

(21) Appl. No.: 11/597,811

(22) PCT Filed: Jan. 28, 2005

(86) PCT No.: PCT/JP2005/001653

§ 371 (c)(1),
(2), (4) Date: Nov. 8, 2007

(87) PCT Pub. No.: WO2006/080095

PCT Pub. Date: Aug. 3, 2006

(65) Prior Publication Data

US 2008/0184461 A1 Aug. 7, 2008

(51) Int. Cl.
*A41B 9/04* (2006.01)
*A41B 9/00* (2006.01)

(52) U.S. Cl. ..... 2/406; 2/400

(58) Field of Classification Search ..... 2/400–408
See application file for complete search history.

(56) References Cited

U.S. PATENT DOCUMENTS 1,904,228 A * 4/1933 Hennessy ..... 2/408
3,852,828 A * 12/1974 Silverstein ..... 2/401
4,612,674 A * 9/1986 Hashimoto ..... 2/406

FOREIGN PATENT DOCUMENTS

| | | |
|---|---|---|
| GB | 962051 | 6/1964 |
| JP | 58-149301 | 9/1983 |
| JP | 63-46405 | 3/1988 |
| JP | 6-4003 | 1/1994 |
| JP | 6-22304 | 3/1994 |

OTHER PUBLICATIONS

International Search Report issued Apr. 5, 2005 in the International (PCT) Application No. PCT/JP2005/001653.

* cited by examiner

*Primary Examiner*—Gloria Hale
(74) *Attorney, Agent, or Firm*—Wenderoth, Lind & Ponack L.L.P.

(57) ABSTRACT

It is an object of the present invention to provide a garment with a crotch part, which can be extremely easily formed and can be supplied at low cost with a small number of parts and joining positions. The garment with the crotch part imparts a difference in stretchability to the crotch part so as to be well fitted to a recess and projections of buttocks to provide three-dimensional feeling of wearing. Further, the garment provides comfortable feeling of wearing by its excellent contact with skin. The garment with the crotch part according to the present invention includes the crotch part formed of two substantially triangular stretchable fabric materials, and apex portions of a rear body are overlapped and joined with apex portions of a front body, respectively.

3 Claims, 5 Drawing Sheets

CLOTHES WITH CROTCH PART

BACKGROUND OF THE INVENTION

I. Technical Field

The present invention relates to a garment with a crotch part, such as a short panty, a panty, a brief, a boxer short, a girdle, a body suit, a bathing suit, and the like. In particular, the present invention relates to a garment with a crotch part which is favorably applied to a short panty for women, includes a small number of parts and joining positions, and which fits buttocks and provides a comfortable wearing feeling.

II. Description of the Related Art

Up to now, there are short panties for women varying in terms of material, color, style, and the like, and consumers purchase products which fit their own tastes. In general, a typical short panty is composed of a front body cloth for covering the lower abdomen, a rear body cloth for covering buttocks, and a crotch cloth, and formed by sewing corresponding side edges of the front body cloth and the rear body cloth together, sewing front and rear edges of the crotch cloth to the front body cloth and the rear body cloth, respectively, and sewing linear tapes onto a top portion of a waist part and bottom portions of leg parts. For adaptation to exercises, the short panty is usually made of a knitted fabric or a woven fabric having stretchability, which is knitted or woven using stretch nylon, polyurethane, or the like.

However, the above-mentioned short panty for women requires many sewing portions such as the side edges of the front body cloth and the rear body cloth, the front and rear edges of the crotch cloth, the top portion of the waist part, and the bottom portions of the leg parts, thereby requiring significant time and effort for a sewing operation by a sewing machine. In addition, "contracting" and "three-dimensional formation" are necessary to make the short panties fit a recess and a projection of the buttocks. Further, there is a problem in that sewn portions become hard and irregular by sewing, resulting in deterioration in contact with skin and wearing feeling.

Under the above-mentioned circumstances, there are proposed three-dimensional unsewn knitted panties each having the front body and the rear body circularly knitted into a tubular shape without being sewn. See for example, the following documents.

1) JP 3403720 B;

2) JP 3403721 B; and

3) JP 2002-327303 A.

That is, the unsewn knitted panties are produced by supplying a yarn to a pair of front and rear needle heads of a knitting machine so that the yarn circulates around those, thereby knitting the front body for covering the lower abdomen and the rear body for covering the buttocks into a tubular shape. The knitting machine starts knitting from the waist part which is to be ribbed, followed by circularly knitting a body part which is to be plain-stitched, and continuously knitting right and left inside leg parts by plain stitching, and completes a pair of knitted panties by finally performing stitching-laying treatment.

SUMMARY OF THE INVENTION

However, while the above-mentioned knitted panties have the advantage that they have stretchability and flexibility inherent in knitted products because there is no sewn part, and have excellent contact with skin because there is no irregularities of sewn parts, there is a concern that a bulge thereof does not fit the body shape of some users because the bulge formed for the buttocks is uniform.

The present invention has been developed in order to solve the above-mentioned problem, and an object of the present invention is to provide a garment with a crotch part, which can be produced extremely easily with a small number of parts and joining portions and supplied at low cost, which provides a three-dimensional wearing feeling by imparting a difference in stretchability to the crotch part and fitting well with a recess and projections of the buttocks, and which provides excellent contact with the skin and a comfortable wearing feeling.

As means for solving the above-mentioned problem and attaining the object of the present invention, there is developed and adopted a garment having a crotch part including two substantially triangular stretchable fabric materials, in which the crotch part is formed by causing respective apex portions of a front body and a rear body to be overlapped and joined to each other.

Further, in the garment having a crotch part formed as described above, there are developed and adopted a garment having a crotch part, in which a substantially triangular patch which decreases in width from the front body toward the rear body, is joined to an inner surface of the crotch part, and a garment having a crotch part in which the joining of the respective apex portions of the front body and the rear body is performed by an adhesive or thermal welding.

The present invention uses substantially triangular fabric materials for the front body and the rear body, so losses at a time of cutting are smaller compared to a case of conventional fabric materials. The garment is formed of only two fabric materials, that is, a front body fabric material and a rear body fabric material and requires no part of a margin tape, rubber, or the like, so the garment becomes inexpensive. The crotch part is intentionally formed so as to be prevented from being stretchable, and a joining portion of the patch is formed to decrease in width rearwards, so the garment fits the recess and the projections of the buttocks and provides a comfortable wearing feeling. Further, there is no tape to be a terraced portion in a waist part or leg parts, so there is no possibility that such portion protrudes, thereby providing a favorable appearance when wearing pants because a panty line does not appear thereon.

DETAILED DESCRIPTION OF THE INVENTION

Figure 1:
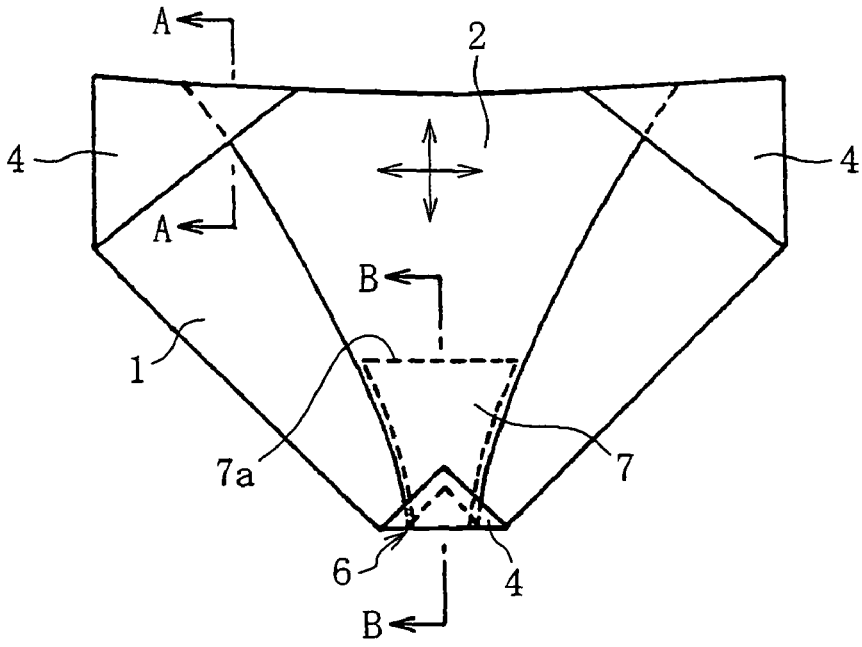
FIG. 1 is a front view of a panty according to an embodiment of the present invention.
Figure 2:
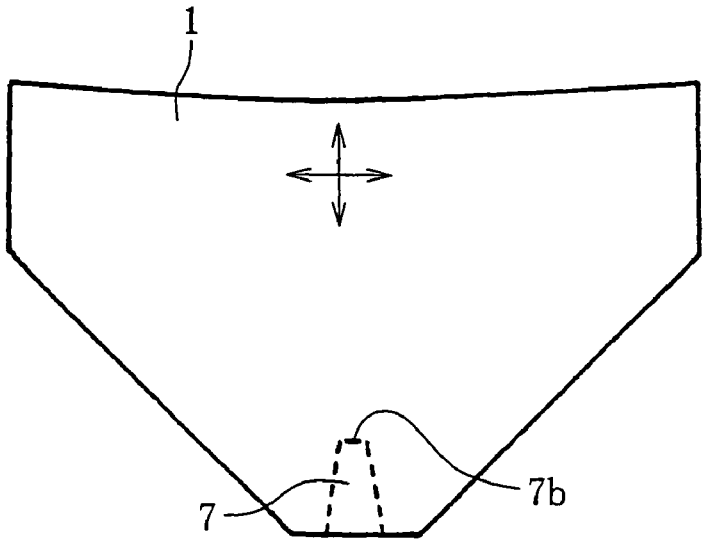
FIG. 2 is a rear view of the panty.
Figure 3:
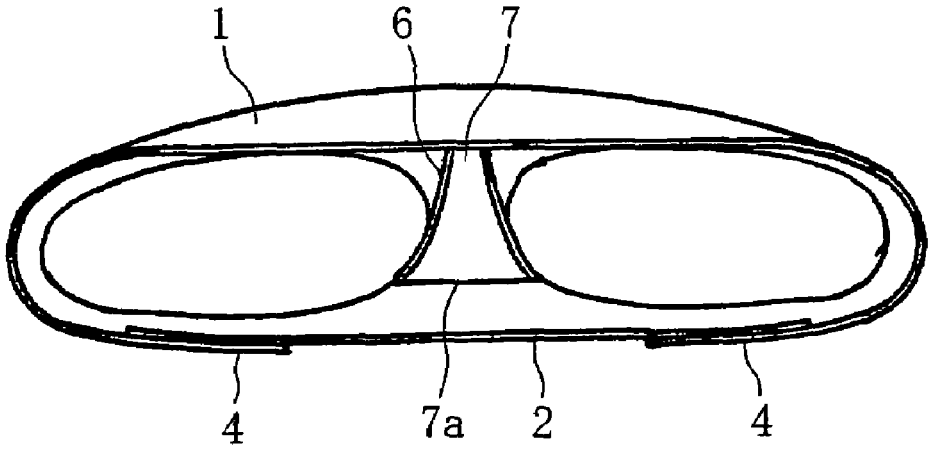
FIG. 3 is a plan view of the panty.
Figure 4:
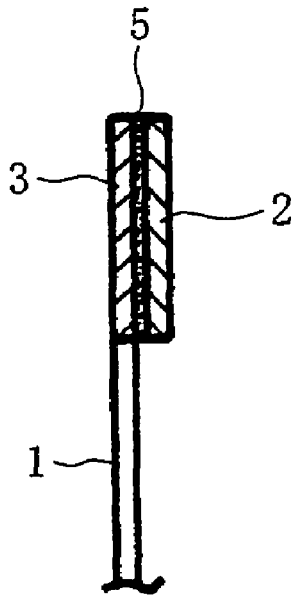
FIG. 4 is a sectional view taken along the line A-A of FIG. 1.
Figure 5:
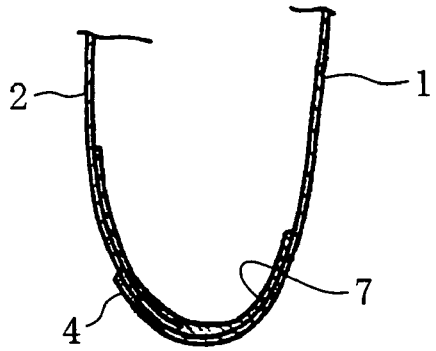
FIG. 5 is a sectional view taken along the line B-B of FIG. 1.

Hereinafter, an embodiment of the present invention will be explained. FIGS. 1 to 3 each shows an example of a panty for women. Joining a rear body 1 for covering the buttocks and a front body 2 for covering a lower abdomen together forms the panty for women.

Figure 6:
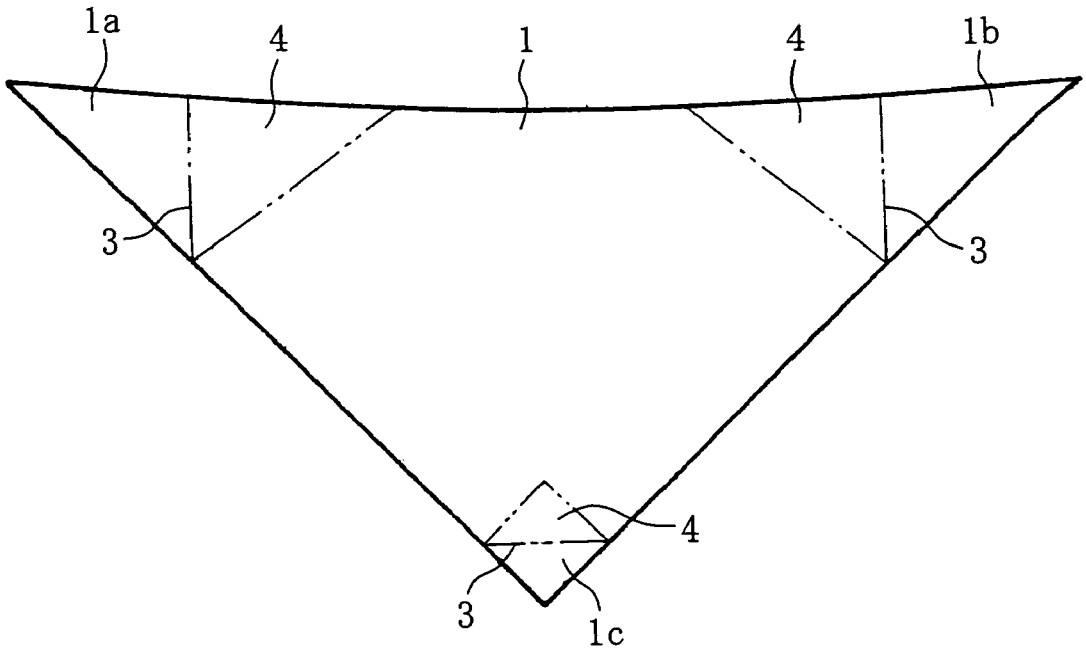
FIG. 6 is a front view of a rear body.

The rear body 1 and the front body 2 are both composed of knitted fabric materials of polyester, polyamide, polyurethane, or the like having stretchability in both longitudinal and lateral directions, and the rear body 1 for covering the buttocks is formed into a large triangular shape. As shown in FIG. 6, the triangular shape is cut in an upside-down triangular shape having an upper side longer than oblique sides thereof, and formed into a shape in which a central portion of the upper side is sank slightly inwardly.

Figure 7:
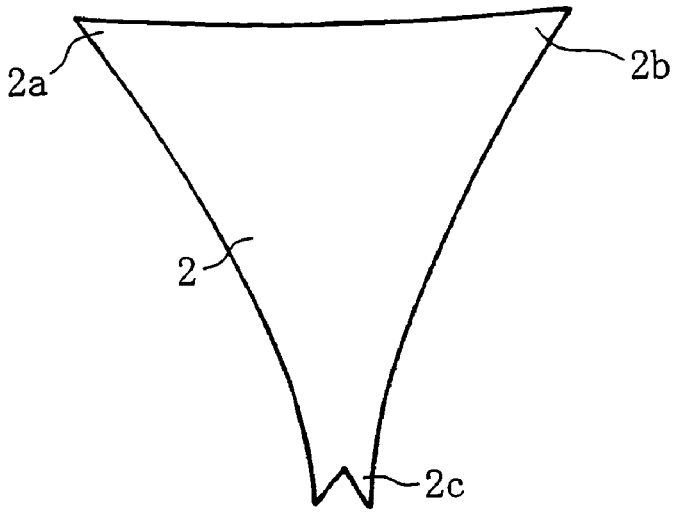
FIG. 7 is a front view of a front body.

On the other hand, the front body 2 is formed into a triangular shape having a relatively small area. As shown in FIG. 7, the triangular shape is cut in a substantially upside-down triangular shape having an upper side constituting a waist part shorter than an oblique side, and oblique sides each longer than the upper side. The upper side is formed so as to have a central portion thereof sank slightly inwardly, the oblique sides are also formed to be sank slightly inwardly, and a lower apex portion is formed into a notched portion notched in a rectangular shape.

A left apex portion 1*a*, a right apex portion 1*b*, a lower apex 1*c* of the rear body 1 are respectively folded to the front body 2 side along folding lines 3, and folded parts 4 thereof are caused to overlap on left and right apex portions 2*a* and 2*b* and lower apex portion 2*c* of the front body 2, respectively. An adhesive 5 is applied onto overlapping portions thus produced to integrally join the folded parts to the respective portions or the overlapping portions are thermally joined by using a high-frequency welder or an ultrasonic welder.

Figure 8:
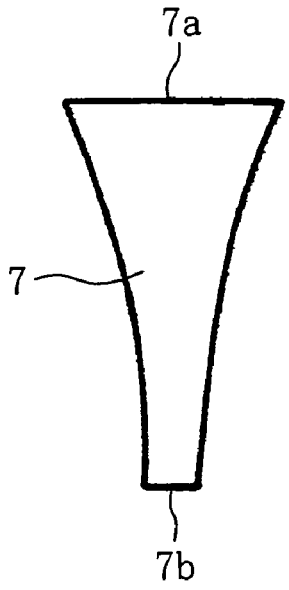
FIG. 8 is a front view of a patch.
Figure 9:
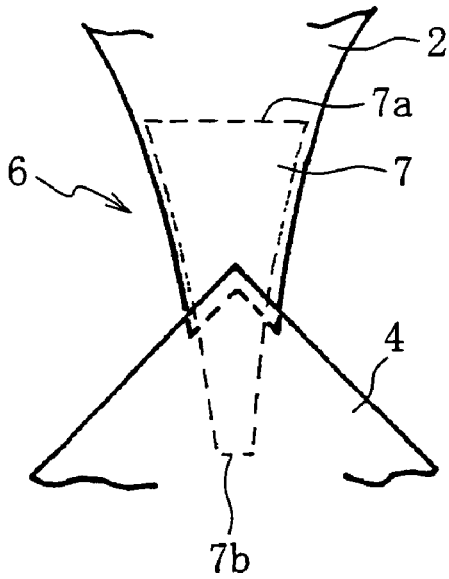
FIG. 9 is a simplified bottom view of a crotch part.

As shown in FIG. 9, a crotch part denoted by reference numeral 6 is formed by joining the folded part 4 of the lower apex portion 1*c* of the rear body 1 and the lower apex 2*c* of the front body 2 together. As shown in FIG. 8, to an inner surface side of the crotch part, a circumference of a substantially rectangular cotton patch 7, having a wide side 7*a* to be attached to the front body 2 side and a narrow side 7*b* to be attached to the rear body 1 side, is joined by using the adhesive 5 or joined by thermal welding. That is, the folded part 4 of the rear body 1 and the lower apex 2*c* of the front body 2 are joined together to control the stretchability thereof, and the patch 7 is applied on the inner surface side thereof to further control the stretchability. In other words, a triplex portion of the folded part 4, the lower apex 2*c*, and the cotton patch 7 is the weakest in stretchability, and a duplex portion of the rear body 1 and the cotton patch 7 and a duplex portion of the front body 2 and the cotton patch 7 are second weakest in the stretchability.

Wearing conditions of the panty for women thus formed are explained in terms of effects and advantages. Because there is no stretch tape formed of rubber or the like provided on a top portion of the waist part, bottom portions of the leg parts, and the like, the panty is easily put on and taken off. On both sides of a front upper surface of the panty, there are overlapping portions of the folded parts 3 of the rear body 1 and the lower apexes 2*c* of the front body 2, which are integrally joined by the adhesive 5 or the thermal welding, so the stretchability is controlled and positions of the waist portion of the front body 2 and the rear body 1 do not deviate from each other. Further, the panties are formed only of the front body 2 and the rear body 1, so extremely nice and soft contact with the skin is provided when worn and the panty fits the body well.

Figure 10:
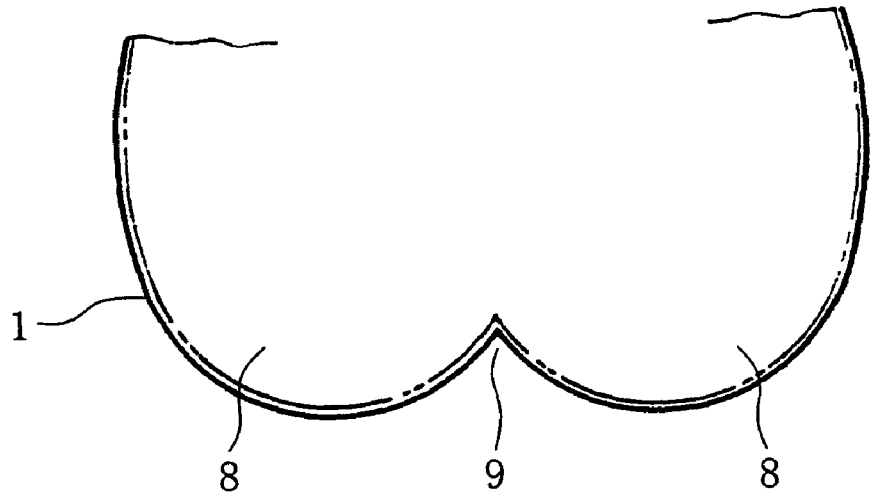
FIG. 10 is an explanatory view of a worn state.

Moreover, in the crotch part 6, the stretchability is controlled by joining among the folded part 4 of the rear body 1, the lower apex 2*c* of the front body 2, and the cotton patch 7, and the patch 7 is formed so as to decrease in width toward the rear body. Therefore, as shown in FIG. 10, the panty fits well along projections 8 and a gap 9, thereby providing a beautiful hip line.

As described above, the main embodiment of the present invention has been explained by taking the panty for women as an example, and the joining method using the adhesive or the thermal welding has been explained. However, the present invention is not limited to those examples. For example, the present invention may be applied to a panty girdle, and sewing can perform the joining. In short, it goes without saying that various design modifications can be made within a range in which the object of the present invention can be attained and the gist of the invention can be maintained.

The present invention is not limited to the short panty for women, and can be applied to a general garment having a crotch part, such as a panty, a brief, a boxer short, a girdle, a body suit, and a bathing suit.

The invention claimed is:

1. A garment having a crotch part, said garment comprising;

two substantially triangular stretchable fabric materials, a first substantially triangular stretchable fabric material of the two substantially triangular stretchable fabric materials being a front body having an apex portion and a second substantially triangular stretchable fabric material of the two substantially triangular stretchable fabric materials being a rear body having an apex portion, wherein the apex portion of the front body and the apex portion of the rear body overlap and join each other to form the crotch part, wherein the crotch part has an inner surface, and wherein a substantially triangular patch, which decreases in width from the front body toward the rear body, is joined to the inner surface of the crotch part.

2. A garment having a crotch part according to claim 1, wherein the apex portion of the front body and the apex portion of the rear body are joined by an adhesive or thermal welding.

3. A garment having a crotch part according to claim 1, wherein the substantially triangular patch is configured to control the stretchability of the garment.

* * * * *